United States Patent [19]

Kashinski

[11] 3,955,656

[45] May 11, 1976

[54] ELASTIC COVER AND SEAL FOR PROTECTING LUGGAGE

[76] Inventor: Albert A. Kashinski, 1914 N. Ode St., Apt. 4, Arlington, Va. 22209

[22] Filed: Aug. 30, 1974

[21] Appl. No.: 501,860

[52] U.S. Cl. ..... 190/41 R; 190/26; 190/57; 206/805; 206/811

[51] Int. Cl.[2] ..... A45C 3/00

[58] Field of Search ..... 220/85 K; 190/26, 41 R, 190/41 Z, 53, 54, 55, 56, 60, 61, 27, 28, 49; 150/3, 52 R; 206/805, 811

[56] References Cited

UNITED STATES PATENTS

| | | | |
|---|---|---|---|
| 2,271,211 | 1/1952 | Stockton | 190/41 Z X |
| 2,432,365 | 12/1947 | Allen | 190/41 Z X |
| 2,436,369 | 2/1948 | Allen | 190/41 Z X |
| 2,617,504 | 11/1952 | Meyers | 190/26 |

FOREIGN PATENTS OR APPLICATIONS

| | | | |
|---|---|---|---|
| 1,153,020 | 9/1957 | France | 206/805 |
| 2,003,476 | 6/1971 | Germany | 150/52 R |

*Primary Examiner*—William Price
*Assistant Examiner*—Stephen Marcus
*Attorney, Agent, or Firm*—Albert A. Kashinski

[57] ABSTRACT

A continuous band of impervious elastic material covers and seals the closure around the periphery of a piece of luggage or similar container. An opening is provided, where necessary, through which the luggage handle protrudes. Various cross-sectional shapes are described for achieving close-fitting conformity with the peripheral side surfaces of the luggage.

20 Claims, 9 Drawing Figures

ELASTIC COVER AND SEAL FOR PROTECTING LUGGAGE

BACKGROUND OF THE INVENTION

America is a nation of travelers; we are constantly on the move. For the price of an airline ticket we change the seasons, or for the price of a tank of gasoline we journey to places where things are still being done as they were by our grandfathers. We fly, we drive, we sail across the oceans. We encounter unfamiliar climates and unfamiliar cultures—some of us have even ventured to the moon and back. But wherever we go, we always manage to carry along at least some of the comforts of home; our luggage is brimming with cherished possessions. And regardless of the method of transportation employed, or prolonged exposures to inclement weather, or the careless behavior of porters and baggage handlers, or our own negligence, we arrive at our destinations with one universal expectation—that our luggage will arrive when we do, on time, and in perfect condition.

Because of the small percentage of time during which a traveler has actual physical control of his luggage, the only way to insure its safe arrival at a destination is to start a trip with luggage that is as secure and indestructible as possible. To meet this need, most commercially available luggage is designed to provide relatively waterproof and dustproof service under normal conditions of use. Sturdy locks and hinges guard against accidental opening, and durable exterior finishes resist damaging and unsightly scuffs and scratches. But in spite of the efforts of manufacturers to secure maximum protection for the contents and exterior components of their luggage, one area remains particularly susceptible to physical damage and intrusion by foreign material. That area is the closure—the place where the opposing shells of a piece of luggage meet at a mechanical joint, and where the locks and hinges lie exposed to blows and snags by the many obstacles encountered in typical use.

On a piece of luggage, the closure is the most fragile component. The intricate locks and hinges, and the close fitting closure joint, lie open to repeated abuse. No matter how waterproof or dustproof the closure is engineered and constructed to be, the commonplace practices of overpacking and rough handling are capable of spreading a potentially troublesome gap in the closure seal. Whether sliding down a chute in a busy airline terminal, or lashed atop an automobile in a driving rainstorm, or simply sitting on a shelf in a dusty closet, the closure is a potential source of aggravation to the hurried and often impatient traveler.

DESCRIPTION OF THE PRIOR ART

Recognizing the need for additional protection beyond that afforded by available luggage, manufacturers have produced various types of covers for protecting luggage. Two such covers are described in U.S. Pat. Nos. 2,520,250 and 2,732,046. Because these covers completely enclose a piece of luggage with a protective layer of durable fabric, a considerable amount of material is required in their manufacture. Because of variations in dimensions between the various makes of luggage and covers, ingenious designs are required to pull the fabric taut and achieve an acceptable fit. Zippers or other intricate fasteners are required to seal the covers and hold them in place. Each of these features adds to the complexity of the cover, to its ultimate retail price, and to the difficulty in maintaining it in effective working condition. It was because of these deficiencies in prior protective luggage covers that my invention was made.

SUMMARY OF THE INVENTION

My invention is an elastic seal for protecting luggage. It prevents the damaging entry of moisture and dust through the closure joint where the opposing shells of the luggage meet. At the same time, it also protects the locks, hinges, and other mechanical components from physical abuse and accidental opening.

The elastic seal consists of a band of rubber, or other suitably impervious elastic material, in the form of a loop which is snugly fitted around the peripheral sides of the luggage, over, and to either side of, the closure joint. The band covers and protects the mechanical components of the closure, while elastic tension draws it against the body of the luggage to prevent the entry of foreign material.

Where appropriate, a lengthwise slot allows the handle to protrude through the band for convenient access. Where desired, one edge of the seal is permanently fixed to the body of the luggage. A modification is described for employing an open band of elastic material for removing and replacing the seal, and for adapting it to luggage of different dimensions, with suitable fasteners. Various additional features, including flat and arcuate cross-sections, raised ribs and dimples, and non-slip interior surfaces are described for adapting the seal for optimum performance with luggage of different designs.

My invention is deceptively simple in appearance, yet remarkably effective in performance. It is convenient to use; with the seal in operating position the luggage can be opened by merely folding on edge of the seal back onto the other to expose the locks and closure joint. My invention obviates the complicated features of prior covers, while providing reliable protection in the critical closure area of the luggage. The seal is relatively simple and inexpensive to manufacture in a wide range of sizes and materials to fit most commercially available luggage. No complicated fasteners are required. And the elimination of substantial coverings over the front and rear side portions of the luggage, which are generally superfluous to protect the durable synthetic body materials used in modern luggage contsruction, results in a considerable reduction in the amount of material required for equivalent protection.

Therefore, one object of my invention is an elastic cover and seal for protecting the closure of an article of luggage from physical damage or the intrusion of foreign material.

Another object of my invention is an elastic cover and seal which does not interfere with the operation of a luggage handle.

Another object of my invention is an elastic cover and seal with a cross-sectional configuration that provides a closely conforming fit with the topography on the peripheral sides of an article of luggage.

Another object of my invention is a luggage cover and seal which is of simple construction and provides maximum protection with a minimum amount of material.

Another object of my invention is a protective luggage cover and seal which need not be completely removed from operating position in order to open the luggage.

Another object of my invention is an elastic cover and seal with fasteners to facilitate attachment and removal, and to accommodate different dimensions of luggage.

These and other objects of my invention are apparent in the following description and drawing.

DESCRIPTION OF THE PREFERRED EMBODIMENT

In the above and following disclosure, several conventions are used to avoid unduly repetitious description: Wherever the words "seal," or "elastic seal," or "cover" are used, the multiple functions of "elastic cover and seal" are included. Wherever the words "luggage" or "suitcase" are used, they are meant to include any similar container with relatively large, hollow, opposing, mated shells which are joined together by locks, hinges, or equivalent fasteners for the purpose of transporting goods or possessions from place to place.

Figure 1:
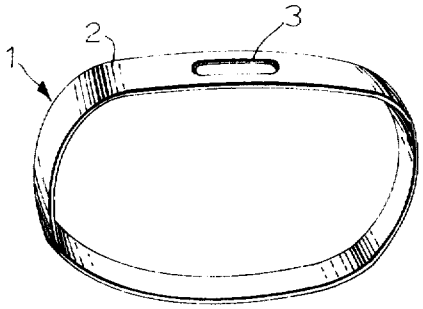
FIG. 1 is a perspective view of an elastic cover and seal for use on an article of luggage.

The elastic seal 1 of my invention is shown in its preferred embodiment in FIG. 1. It comprises a band 2 of rubber, or other suitably impervious elastic material, in the form of a substantially closed loop, with an elongated lengthwise opening 3 for allowing a luggage handle to protrude. It is preferably elastic in all directions, but at least is so over most of its length in the direction of its circumference.

Figure 2:
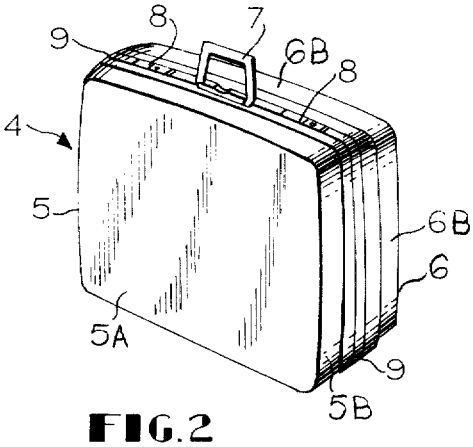
FIG. 2 is a perspective view of a typical article of luggage.

A typical article of luggage for use with my invention is shown as a suitcase 4 in FIG. 2. The suitcase has substantially hollow, mated, opposing shells 5 and 6 which are hinged (not shown) to open and close in a facing relationship. The shells 5 and 6 include relatively large front 5A and rear (not shown) side body portions, and narrower peripheral side portions 5B and 6B, the latter of which are visible for only two of the four peripheral sides in FIG. 2. A handle 7 is fixed to one of the shells, and locks 8 are used to prevent accidental or unauthorized opening.

When closed as shown, the opposing shells 5 and 6 of suitcase 4 meet in the area of the peripheral side portions at a mechanical closure joint 9, which is typically designed to protect the interior of the suitcase from the intrusion of moisture and dust under normal conditions. Often, however, as is the case when overpacked or roughly handled, the typical closure joint 9 is insufficient to protect the contents (not shown) from the intrusion of foreign material. In addition, the entire closure, which consists of the hinges (not shown), locks 8, and joint 9, is often exposed to the damaging effects of physical blows. Where dusty conditions prevail, even if the closure joint remains intact the exterior portions are subject to collecting deposits of dust on their surfaces, and soiling the contents when the suitcase is opened. In order to prevent these undesirable consequences in an economically and aesthetically appealing manner, the elastic seal 1 of my invention is used.

Figure 3:
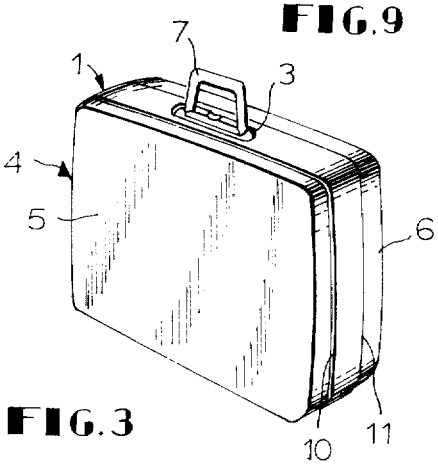
FIG. 3 is a perspective view of the seal of FIG. 1 in operating position on the luggage of FIG. 2.

FIG. 3 shows the elastic seal 1 in operating position on a suitcase 4. The seal overlies closure joint 9 and the adjacent peripheral side portions around the periphery of the suitcase, covering the locks and hinges, with handle 7 protruding through opening 3. The overall circumference of the seal 1 is somewhat less than the peripheral dimension of the suitcase adjacent to the closure, so that the seal is stretched under tension in at least the direction of the closure joint, and held snugly against the peripheral sides of the suitcase. On either edge 10 and 11, which extend substantially parallel to the closure joint the seal 1 covers the peripheral sides of shells 5 and 6 a sufficient extent to form a smooth continuous seal.

Figure 4:
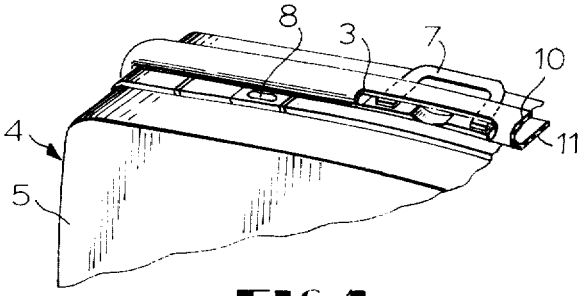
FIG. 4 is a fragmentary perspective view illustrating the technique for folding the cover and seal edge-over-edge in order to gain access to the luggage interior.

When opening the suitcase 4 it is not necessary to entirely remove the elastic seal 1 from the position shown in FIG. 3. Instead, one edge 10 of the seal is folded over the other opposite edge 11, while the edge 11 remains substantially in its original position, as partially shown in FIG. 4. The handle 7 folds out of the way beneath the seal, exposing the locks 8 for convenient access. After the suitcase is closed and locked, the edge 10 of seal 1 is folded back over the closure to the sealed position.

Figure 5:
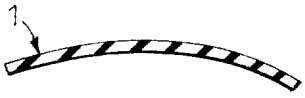
FIG. 5 is a cross-sectional view of one embodiment of the seal shown in FIG. 1.
Figure 6:
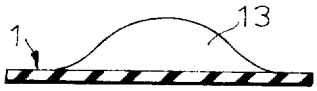
FIG. 6 is a partial cross-sectional view of a second embodiment of the seal shown in FIG. 1.
Figure 7:
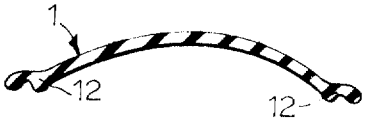
FIG. 7 is a cross-sectional view of a third embodiment of the seal shown in FIG. 1.

Depending on the specific topography of the peripheral side portions of different suitcases used with elastic seal 1, different cross-sectional shapes of band 2 are employed. An arcuate cross-section, as shown in FIG. 5, is one shape which gives satisfactory performance. Other cross-sectional shapes take advantage of the sealing properties of the raised ribs which often extend around the periphery of a suitcase, or they allow for the idiosyncrasies of individual suitcase designs. For example, the seal 1 can have a flat cross-section, as shown in FIG. 6, or an arcuate cross-section with ribbed edges, as shown in FIG. 7. Non-skid inner surfaces are used, where appropriate, to prevent slippage. In addition, raised, molded dimples 13, or perforations (not shown) provide clearance for bulky locks, hinges, or other projections (not shown) which lie on the peripheral body of a suitcase.

Figure 8:
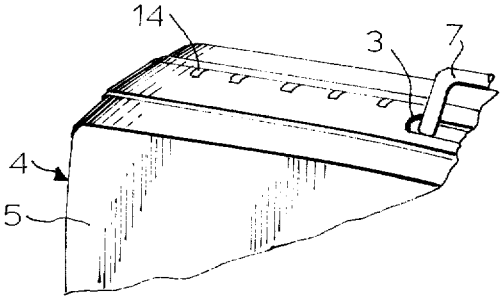
FIG. 8 is a fragmentary perspective view of a typical article of luggage with the elastic cover and seal of FIG. 1 permanently mounted in operating position.

While the elastic seal 1 is shown in the preferred embodiment with a frictional grip on the suitcase 4, one edge of the seal can be permanently attached by a metal clip 14, as shown in FIG. 8, by adhesive, or by other suitable fastener.

Figure 9:
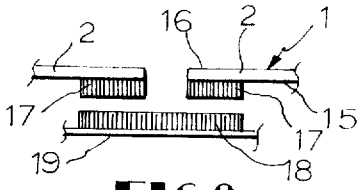
FIG. 9 is an exploded partial side view of an embodiment of the seal of FIG. 1, for which closure is achieved by a detachable fastener.

While seal 1 is shown in the preferred embodiment with the ends joined in an endless loop, for some applications it is desirable to join the opposite ends with a detatchable fastener to facilitate attachment and removal, or to permit shortening or lengthening of the seal to fit different suitcase dimensions. An example of this alternative is shown in FIG. 9, where the ends of band 2 are shown in a side view as positioned for attachment by the male 17 and female 18 connectors of a commercially available Velcro strip. The seal can be used with either side 15 or 16 of band 2 in contact with the sides of the suitcase. Where the side 15 on which the Velcro strip is mounted is in contact, the female connector 18 can be permanently fixed to the suitcase shell 19, and recessed a sufficient amount to allow band 2 to lie flat against the closure. A convenient location for mounting the fastener in this way is between the hinges of the associated peripheral side portion, and to either side of the closure joint. In this centralized location, the fastening material provides additional sealing power on what is commonly the supporting surface of the suitcase, and which, because of this function, usually receives the greatest amount of direct physical absue. Wherever it is mounted, the fastener is made sufficiently flexible to permit folding of the seal when the suitcase is opened.

While elastic seal 1 provides reliable protection when only the peripheral sides are covered in the area adjacent to the closure, an extension of band 2 around the edges a short distance and onto the large front and rear side portions of the suitcase to form a protective bumper is contemplated within the scope of my invention. And while the preferred embodiment is shown as an homogeneous band of elastic material, composite structures such as webbing or other impervious films with suitable longitudinal elastic properties are also contemplated. In addition, where the suitcase handle is spaced far enough from the closure to avoid interfering with the operation of the seal, the opening 3 is superfluous and a suitably constructed imperforate band can be used in a manner similar to that shown for the preferred embodiment.

While my invention is shown and described by reference to a specific preferred embodiment, modifications within the scope of this disclosure are expected. For this reason, the scope of my invention is limited only by the following claims.

I claim:

1. In an article of luggage having:

two substantially hollow, opposing, mated shells with side body portions and adjoining peripheral side portions, means for fastening the shells in a closed, mated relationship to define a closure joint in the area of the peripheral side portions, and a handle for carrying the luggage from place to place, the improvement comprising:

a band of impervious material overlying substantially the entire closure joint and covering the peripheral side portions in the area adjacent to the closure without covering the side body portions to any substantial extent, the band having elastic properties at least in the direction of, and substantially over, its entire length.

2. An article of luggage as claimed in claim 1, in which:

the band includes opposite ends, and a fastening device for joining and separating the opposite ends.

3. An article of luggage as claimed in claim 2, in which:

at least a portion of the fastening device is permanently fixed to the article of luggage.

4. An article of luggage as claimed in claim 2, in which:

the band includes at least one raised rib which lies in contact with the surface of the luggage.

5. An article of luggage as claimed in claim 2, in which:

the band includes an opening through its surface for allowing the handle to protrude.

6. An article of luggage as claimed in claim 1, in which:

the band includes at least one raised rib which lies in contact with the surface of the luggage.

7. An article of luggage as claimed in claim 6, in which:

the band includes an opening through its surface for allowing the handle to protrude.

8. An article of luggage as claimed in claim 6, in which:

the band is permanently fastened to the article of luggage.

9. An article of luggage as claimed in claim 1, in which:

the band includes an opening through its surface for allowing the handle to protrude.

10. An article of luggage as claimed in claim 9, in which:

the band is permanently fastened to the article of luggage.

11. An article of luggage as claimed in claim 1, in which:

the band is permanently fastened to the article of luggage.

12. An article of luggage as claimed in claim 3, in which:

the band includes at least one raised rib which lies in contact with the surface of the luggage.

13. An article of luggage as claimed in claim 3, in which:

the band includes an opening through its surface for allowing the handle to protrude.

14. An article of luggage as claimed in claim 4, in which:

the band includes an opening through its surface for allowing the handle to protrude.

15. An article of luggage as claimed in claim 12, in which:

the band includes an opening through its surface for allowing the handle to protrude.

16. An article of luggage as claimed in claim 7, in which:

the band is permanently fastened to the article of luggage.

17. A method for protecting an article of luggage having a closure, a closure joint, peripheral side portions, and said body portions from physical abuse and the entry of foreign material comprising:

covering the closure and peripheral side portions of the luggage in the area over and adjacent to the closure with a substantially continuous, close-fitting band of impervious material having two opposite edges that extend substantially parallel to the closure joint and having elastic properties at least in the direction of the closure joint, without covering the side body portions of the luggage to any substantial extent, folding one edge of the band over onto the other edge along substantially its entire length to expose the luggage closure joint, while the other edge remains substantially in place on the peripheral side portions of the luggage, in order to gain access to the interior of the luggage, and folding the one edge back to substantially its original position to re-seal the luggage.

18. A method as claimed in claim 17, in which the step of covering includes the additional step of:

passing a handle on the luggage through an opening which extends through the surface of the band.

19. A method as claimed in claim 17, in which the band includes opposite ends and the step of covering includes the further step of:

joining the opposite ends of the band with a fastening device.

20. A method as claimed in claim 19, in which the step of covering includes the additional step of:

passing a handle on the luggage through an opening which extends through the surface of the band.

* * * * *